United States Patent [19]

Quambusch et al.

[11] Patent Number: 4,488,419

[45] Date of Patent: Dec. 18, 1984

[54] SKEW ROLLING MILL FOR TUBES

[75] Inventors: Albert Quambusch, Meerbusch; Wilfried Schöneberg, Düsseldorf, both of Fed. Rep. of Germany

[73] Assignee: Kocks Technik GmbH & Co., Hilden, Fed. Rep. of Germany

[21] Appl. No.: 400,478

[22] Filed: Jul. 21, 1982

[30] Foreign Application Priority Data

Aug. 19, 1981 [DE] Fed. Rep. of Germany ..... 3132712

[51] Int. Cl.[3] ..... B21B 31/08

[52] U.S. Cl. ..... 72/95; 72/238

[58] Field of Search ..... 72/95, 96, 99, 100, 72/238, 239

[56] References Cited

FOREIGN PATENT DOCUMENTS 388799 7/1973 U.S.S.R. ..... 72/95

651861 3/1979 U.S.S.R. ..... 72/95

*Primary Examiner*—Lowell A. Larson

*Attorney, Agent, or Firm*—Buell, Blenko, Ziesenheim & Beck

[57] ABSTRACT

A skew rolling mill for tubes is provided having a stand upright in two parts laterally separable along a vertical parting line, one part being fixed and the other movable horizontally transverse to the pass line of the mill, a pair of driven skew rolls journaled adjacent one another and inclined to the pass line, and a pair of driven guide discs journalled in the stand upright to be disposed in a vertical plane, one above and one below the pass line, the rolls and clamps being removable toward the vertical parting line and tie rods subject to pre-stress by hydraulically movable nuts.

24 Claims, 8 Drawing Figures

SKEW ROLLING MILL FOR TUBES

The invention relates to a skew rolling mill for tubes, having a pair of driven skew rolls which are journalled adjacent to one another so as to be inclined relative to the rolling axis or pass line, and a pair of driven guide discs which are also disposed in a vertical plane and above and below the rolling axis.

In a known rolling mill of this kind (U.S. Pat. No. 2,042,832), the skew rolls and also the guide discs are journalled at each end in a rolling stand of frame-like construction. The skew rolls of a rolling mill of this kind, and particularly the guide discs, wear relatively rapidly, so that they frequently have to be changed. It is extremely expensive and time-consuming to change the skew rolls and the guide discs owing to the frame-like construction of the rolling stand and the type of mounting. Long down times result which greatly reduce the efficiency of the known rolling mill. In the case of the relatively solid skew rolls, this work and consumption of time is kept within limits, since the skew rolls do not have to be exchanged as frequently as the guide discs. Therefore, a number of various kinds of construction have been developed which are intended to facilitate replacement, particularly replacement of the guide discs. Thus, for example, in a type of construction which is also known (German Patent Specification (Auslegeschrift) No. 21 56 595), the two skew rolls are disposed one above the other, and the two guide discs are disposed adjacent to one another in a common horizontal plane and at each side of the pass line. Namely, the guide discs extend through lateral windows in the rolling stand into the working region of the skew rolls and, since they are mounted on levers, can be swung laterally out of the rolling stand where they are more readily accessible for the purpose of changing them. Although the guide discs in this type of construction can be removed in a shorter time than in the first-mentioned type of construction, the skew rolls are still located in the interior of the rolling stand and are not readily accessible and can be exchanged only at considerable expense. This applies particularly to the lower skew roll.

An object of the invention is to provide a skew rolling mill for tubes, whose skew rolls and guide discs are equally readily accessible, can be readily exchanged, and which nevertheless are mounted in a largely play-free manner in a stable rolling stand during operation.

Accordingly the present invention provides a skew rolling mill for tubes, having a stand upright in two parts which are laterally separable along a substantially vertical parting line, and having a pair of driven skew rolls which are journalled adjacent to one another so as to be inclined relative to the pass line, and a pair of driven guide discs which are also disposed in a vertical plane and respectively above and below the pass line, one skew roll and the two guide discs being journalled in one part of the stand upright, and the second skew roll is journalled in the other part of the stand upright, the skew rolls and guide discs being removable towards the substantially vertical parting line, and means being provided to enable the two parts of the stand upright to be clamped together in a play-free manner.

By virtue of splitting the stand upright vertically into two parts, and by virtue of the fact that at least one of the two parts of the stand upright is laterally movable, sufficient space can be provided in the region of the rolling axis or pass line for direct manual access to all exchangeable parts for the purpose of maintenance and exchanging the skew rolls and/or the guide discs, so that these parts can be exchanged very rapidly and with only a small expenditure of labour.

In this manner, very short down times can be obtained, thus leading to a high degree of utilization of the rolling mill in accordance with the invention. Furthermore, the adjusting travel of the guide discs need only be short, since they no longer have to be swung to a considerable extent from the region of the rolling stand for the purpose of exchanging them. This permits a substantially more stable and play-free construction, this being of particular importance for satisfactory, true-to-size deformation of the work material. Since neither the skew rolls nor the guide discs have to be removed from openings in the rolling stand, such openings can be omitted, thus enabling a particularly stable construction of the rolling stand. Reinforcements, cross-struts or the like can be provided whereever necessary, without having to take into account free access to the skew rolls or guide discs.

Although it is quite conceivable to construct both parts of the stand upright so as to be laterally movable, this would be an unnecessary expense, since two guide tracks and two drives having working cylinders, toothed racks, spindles or the like would have to be provided for the parts of the stand uprights, without obtaining any other substantial advantage. Adequate space for fitting and removing the skew rolls and guide discs can be provided without difficulty even by making only one part of the stand upright movable. The fact that one skew roll and the two guide discs are to be commonly disposed in the stationary part of the stand upright has the advantage that the drive for this roll and the guide discs is also stationary and the structural expense of the drive elements can be minimized. It is then only necessary to design the drive for the second skew roll such that the transmission element between the stationary motor and transmission unit and the skew roll permits lateral movement of the part of the stand upright. However, this does not prevent any structural problem, since, in the case of skew rolling mills for tubes, relatively long universal-joint or cardan shafts are, in any case, used between the stationary motor and transmission unit and the adjustable skew rolls. Therefore, there is no appreciable extra expense. Nevertheless, it is conceivable to distribute the skew rolls and guide discs between the two parts of the stand upright in some other manner.

In a preferred embodiment of the invention, the parts of the stand upright are clampable to one another by means of tie rods which are subjected to pre-stress by means of hydraulic nuts. Interconnection of the two parts of the stand upright in this manner is extremely stable and permits satisfactory mounting of the skew rolls and the guide discs. The elasticity of the rolling stand as a whole is greatly limited. Moreover, such interconnections between the two parts of the stand upright are very suitable for automatic operation, so that the amount of manual labour when exchanging the guide discs or skew rolls is minimized.

In the aforementioned embodiment of the invention, it is advisable to dispose the tie rods in one part of the stand upright and to provide them with T-heads which engage corresponding recesses in the respective other part of the stand upright, the T-heads being turned into their clamping positions in the recesses and subjected to pre-stress. The tie rods constructed in this manner permit rapid and reliable clamping of the two parts of the stand upright and, moreover, take up only a small amount of space.

In a further development of the invention, the guide discs are overhung-mounted and are clamped in a play free and rotationally fixed manner on their drive shaft by a tie rod of greater length which is prestressed by a preferably removable hydraulic arrangement. By virtue of the fact that the rolling stand is subdivided into two parts, and the guide discs are removed towards the parting line, the over-hung mounting of the guide discs is particularly advisable. In the case of known overhung mounted guide discs, the guide discs are secured to their drive shafts by standard nuts and thus without any appreciable pre-stress. However, the application of a maximum pre-stress is essential for the overhung mounting and can only be achieved by a corresponding device, preferably a hydraulic device. This is the only way in which it can be ensured that the guide discs are actually mounted on their drive shafts in a play-free manner, it being advisable for the seat of the drive discs on the drive shafts to be of conical construction. The guide discs are accurately fixed on the drive shafts in this manner although, nevertheless, they can be readily released for the purpose of exchanging them.

Furthermore, it is advisable to provide two wedge-shaped parts for each of the radially and axially adjustable guide discs for the purpose of clamping them in a play-free manner in the stationary part of the stand upright, a clamping piece of the guide disc bearing housing being held between the mutually facing sloping surfaces of the wedge-shaped parts whose parallel outer surfaces are disposed between parallel guide surfaces of the stationary part of the stand upright, a first wedge-shaped part being secured to the guide disc bearing housing so as to be adjustable relative thereto, and a second wedge-shaped part being coupled to the first wedge-shaped part by way of a clamping cylinder. In this manner, it can be ensured that, on the one hand, the guide disc bearing housings and thus the guide discs themselves can be radially and axially adjustable to an adequate extent and at low expenditure, and that, on the other hand, the guide discs can be reliably locked in a play-free manner in any desired position.

In accordance with a further feature of the invention, the skew rolls guided and held by chocks of the parts of the stand upright are journalled in separate bearing housings which are provided one at each end of each roll and disposed in the chocks, the bearing housing being held in a play-free manner by clamping wedges which are each clamped and held by only one bolt or nut per bearing. This also promotes the ready interchangeability of the skew rolls by virtue of the fact that they can be removed from the respective part of the stand upright together with the bearing housings, namely in the region of the parting line, when the two parts of the stand upright have been moved apart. It is then only necessary to release one bolt or nut per bearing housing by access afforded at the parting line, generally two bolts or nuts per skew roll, and it is possible to remove the skew rolls together with the bearing housing. A construction of this kind would not be possible in the case of a skew rolling mill of conventional construction in which there is insufficient space available in order to be able to exchange the skew rolls in this manner.

The invention is further described, by way of example, with reference to the accompanying drawings, in which.

Figure 1:
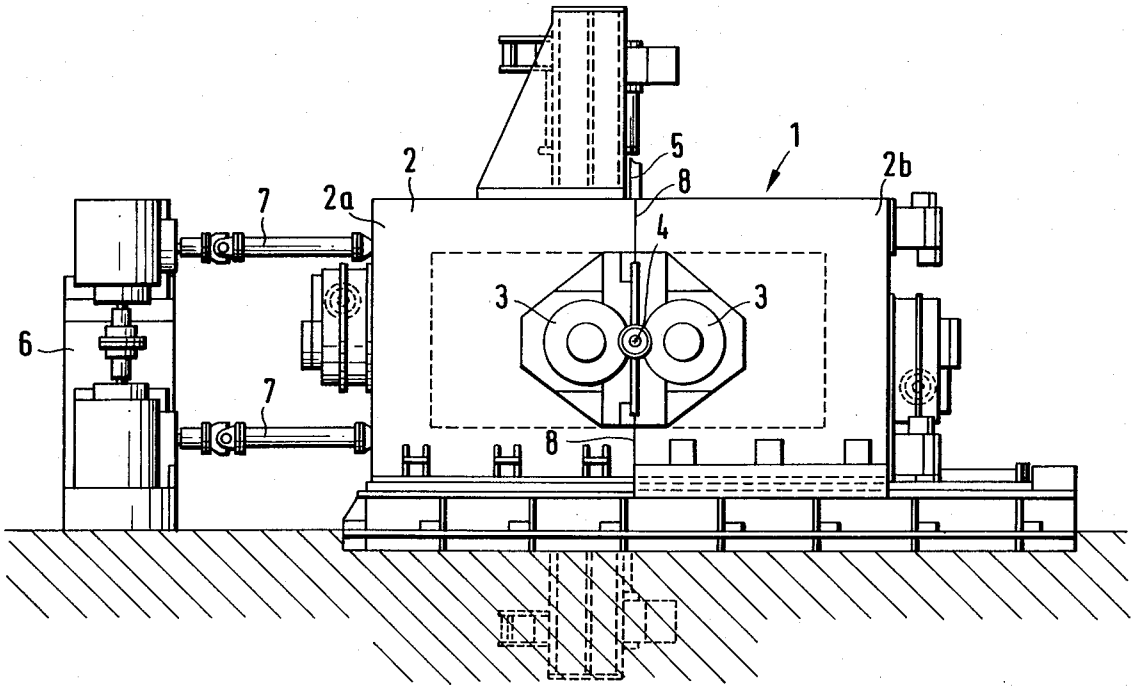
FIG. 1 is an end elevation, viewed from the entry end of the work material, of a skew rolling mill for tubes, in accordance with the invention, ready for operation.

Referring to FIG. 1, a rolling mill 1 for tubes has a frame-like rolling stand 2. Two skew rolls 3 are journalled in the rolling stand and are disposed so as to be inclined relative to the rolling axis or pass line 4. This inclination of the rolls cannot be perceived in FIG. 1. Respective guide discs 5 driven by a drive 6 by way of universal-joint or cardan shafts 7 are located between the skew rolls 3 above and below the pass line 4. The lower guide disc 5 is not shown in FIG. 1, since it is obscured by the front plate of the rolling stand 2. The skew rolls 3 are also driven although their drive is not shown in FIG. 1. However, a parting line 8 which subdivides the rolling stand 2 into two parts 2a and 2b of the stand upright is clearly visible.

Figure 2:
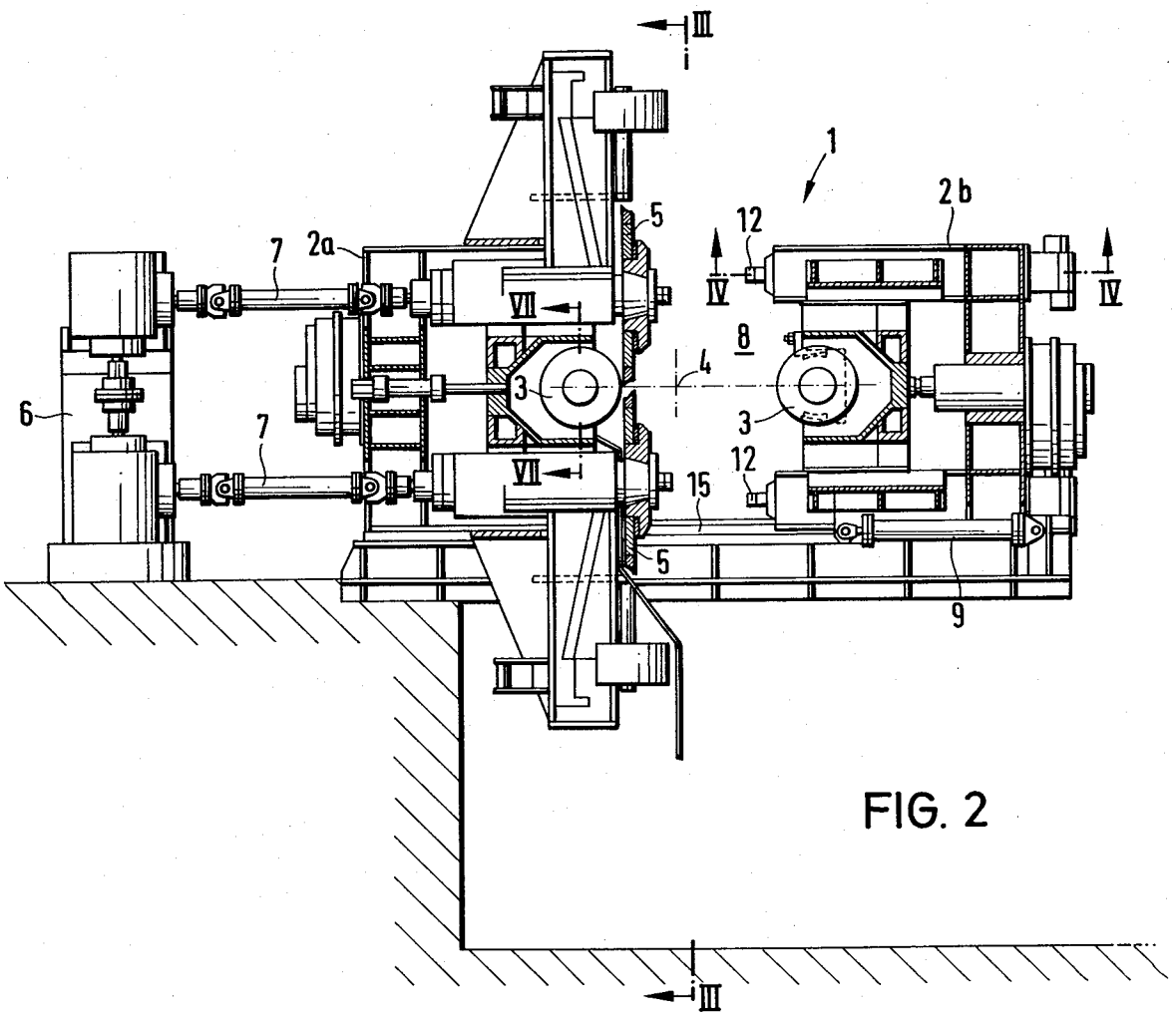
FIG. 2 is a fragmentary section through the rolling mill of FIG. 1, before or after changing the guide discs.

In FIG. 2, the two parts 2a and 2b of the stand upright are shown in the position in which they have been moved apart, that is to say, the part 2b of the stand upright has been displaced to the right by means of a hydraulic working cylinder 9, whereas the part 2a of the stand upright is stationary. In this manner, the parting line or joint 8, which is closed in FIG. 1, is opened up so that one can enter between the two parts 2a and 2b of the stand upright in order to exchange or check the skew rolls 3 and/or the guide discs 5. Removal of these parts is achieved at the parting line or joint 8 which has been opened out in this manner and which offers sufficient space to give access for this purpose.

Figure 3:
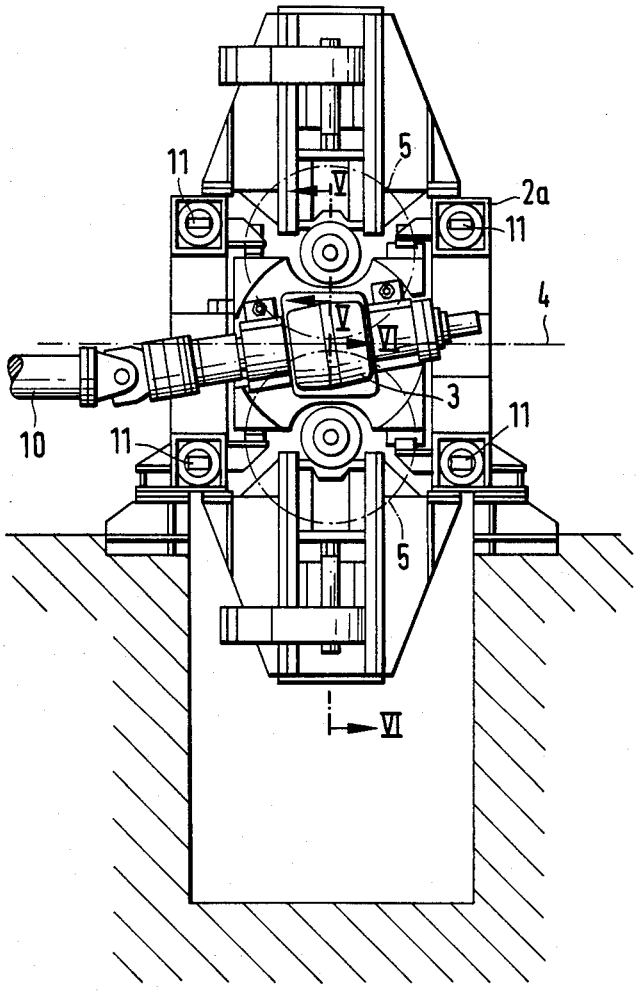
FIG. 3 is a section taken along the line III—III of FIG. 2.
Figure 4:
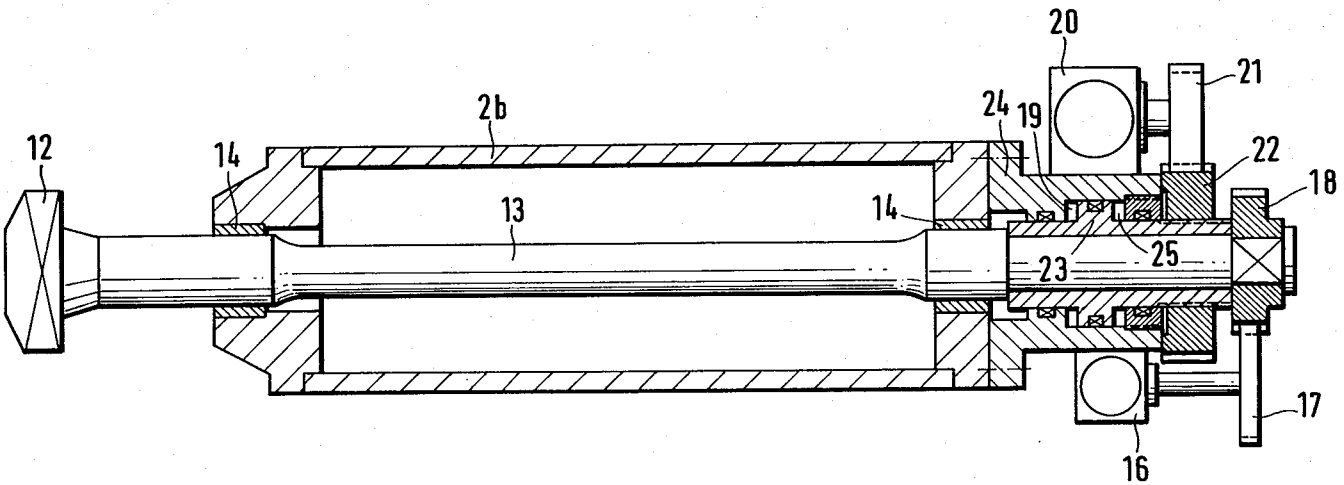
FIG. 4 is a section taken along the line IV—IV of FIG. 2, showing a tie rod.

The inclination of one of the skew rolls 3 relative to the rolling axis 4 is clearly shown in FIG. 3. FIG. 3 also shows the end portion of an articulated shaft 10 which drives the skew roll 3. The guide discs 5 are only indicated by dash-dot circles in FIG. 3. Four locations of the stationary part 2a of the stand upright incorporate rectangular openings 11 which can receive hammer heads or T-heads 12 shown in FIG. 2. The T-heads 12 form the front end portions of tie rods 13 which are longitudinally displaceable and rotatably guided in the interior of the laterally movable part 2b of the stand upright, this being shown in detail in FIG. 4 in which the bearing bushes for a tie rod of this kind are designated 14.

In order to transform the skew rolling mill from its state, illustrated in FIG. 2, before or after exchanging the skew rolls or guide discs, into its operating state shown in FIG. 1, pressure medium has to be admitted to the working cylinder 9, so that the part 2b of the stand upright, which can be moved laterally on a guide 15, moves to the left and closes the parting line or joint 8.

The T-heads 12 thereby engage the openings 11 in the stationary part *2a* of the stand upright, and are then turned through 90°. This rotary movement is produced by a motor 16, shown in FIG. 4, by way of a pair of gear wheels 17 and 18. A pressure medium is then admitted to a pressure chamber 19 and acts on a piston portion 23 on the tie rod 13, so that the tie rod 13 shown in FIG. 4 moves to the right and is subjected to pre-stress, since the T-head 12, after rotation through 90°, can no longer move out of the opening 11 in the stationary part *2a* of the stand upright. The two parts *2a* and *2b* of the stand upright are thereby clamped to one another, and the tie rod is subjected to high pre-stress. In order to maintain this pre-stress without also having to maintain the pressure of the pressure medium in the pressure chamber 19, a motor 20 tightens a nut 22 on the piston portion 23 in a clockwise direction by way of a gear wheel 21, so that the position of the piston portion 23 of the tie rod 13 achieved by the pressure medium is maintained relative to a cylindrical portion 24 of the part *2b* of the stand upright. The pressure of the pressure medium in the pressure chamber 19 can then be relieved, without losing the pre-stress of the tie rod 13. In this manner, the two parts *2a* and *2b* of the stand upright are rigidly interconnected and are able to absorb the forces resulting from the rolling pressure.

If the laterally movable part *2b* of the stand upright has to be released for the purpose of maintenance, pressure medium is again admitted to the pressure chamber 19 in order to relieve the stress on the nut 22 which can then be loosened by means of the motor 20. If the pressure of the pressure medium is then allowed to escape from the pressure chamber 19, the tie rod 13 is also relieved of stress. The tie rod 13 can subsequently be displaced on the left as viewed in FIG. 4 by admitting pressure medium to a pressure chamber 25 at the other end of the piston portion 23. The T-head 12 is then released from the interior bearing surface of the stationary part *2a* of the stand upright and can again be turned through 90° by means of the motor 16 and the gear wheels 17 and 18, so that it can be withdrawn from the opening 11 by means of the working cylinder 9 which removes the entire laterally movable part *2b* of the stand upright from the stationary part *2a* of the stand upright. It will be appreciated that the operation described above can be effected automatically and can be performed in a few moments.

Figure 5:
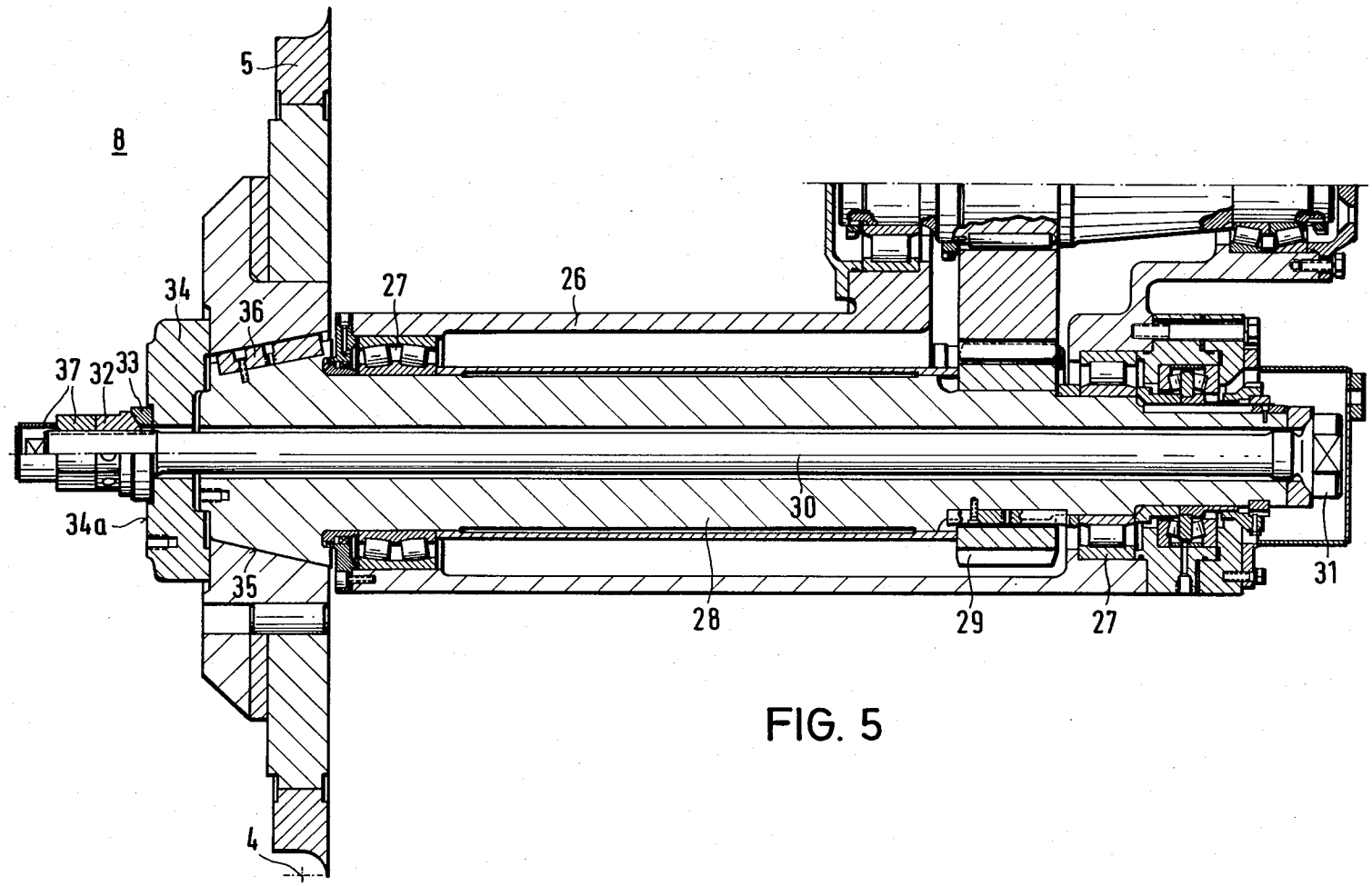
FIG. 5 is a section taken along the line V—V of FIG. 3, showing the mounting for one of the guide discs.

The overhung mounting of the guide discs 5 and their play free and rotationally fixed connection to their drive shaft are shown in detail in FIG. 5. Referring to FIG. 5, a drive shaft 28 for the guide disc 5 is journalled in a guide disc bearing housing 26 by means of roller bearings 27 so that it is fixed in position and free from play in an axial direction. The drive shaft 28 is driven by a gear wheel 29 which is in turn connected to the drive 6 by way of an intermediate transmission (not fully illustrated) and the cardan shafts 7.

An interior bore of the drive shaft 28 accommodates a tie rod 30 whose rear end portion 31 is supported against the drive shaft 28. The tie rod 30 is subjected to pre-stress and maintains the multi-part guide disc 5 pressed against a conical seat 35 of the drive shaft 28 by means of a nut 32 by way of a thrust piece 33 and a thrust plate 34. At least one key 36 is provided to ensure the transmission of torque. The nut 32 is secured by a lock nut 37 having a protective cap for the front end portion of the tie rod 30.

If the guide disc 5 is to be exchanged, the lock nut 37 is removed and a removable hydraulic arrangement (not illustrated) is screwed onto the front end portion of the tie rod 3 and then abuts against the thrust plate 34, that is to say, against pressure-bearing surfaces 34*a*. The pre-stress of the tie rod 30 is increased by a small amount, so that the nut 32 is relieved of load and can be loosened. The hydraulic arrangement is then also released, and thus the prestress of the tie rod 30 is removed, so that the nut 32 can be unscrewed from the tie rod 30 after the hydraulic arrangement has been removed. The guide disc 5 is then ready to be exchanged. The guide disc can be removed towards the widened joint 8 and can be replaced by a fresh guide disc. The fresh guide disc 5 is fitted analogously in a reverse sequence, again with the use of the hydraulic arrangement (not illustrated). This method for securing ensures a play-free seat for the guide disc 5 which, on the one hand, is reliable and, on the other hand, can be readily released.

Figure 6:
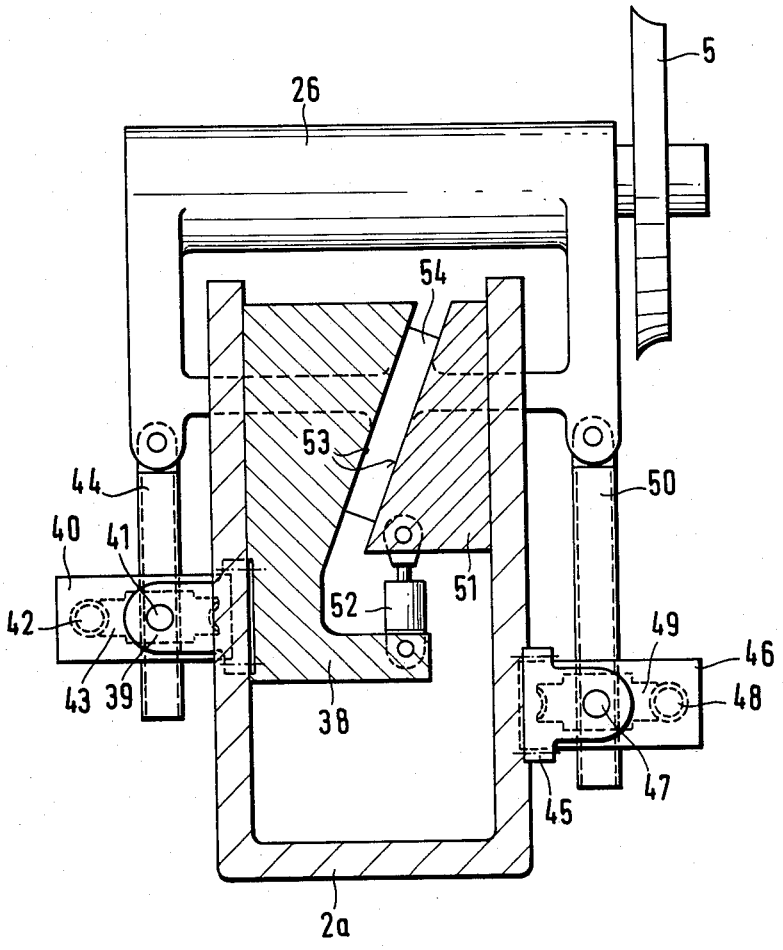
FIG. 6 is a section taken along the line VI—VI of FIG. 3, showing the support for the lower guide disc.

The guide discs 5 have to be adjustable both in an axial and in a radial direction. Moreover, it must be possible to lock them in a reliable manner in any position. The device provided for this purpose is shown in FIG. 6. In this region, the stationary part *2a* of the stand upright is of U-shaped construction. A first wedge-shaped part 38 is located within this U-shape and is secured to the guide disc bearing housing 26 by way of a hinge piece 39 and a support member 40 which is held in the hinge piece by means of a hinge 41. A rotatable worn wheel 43 driven by a worm 42 is located in the support member 40 and is screwed onto a screw-threaded spindle 44 which is hinged to the guide disc bearing housing 26. When the worm 42 is activated, the worm wheel 43 rotates and, together with the support member 40, the hinges 41 and the hinge piece 39, is moved relative to the screw-threaded spindle 44 and thus relative to the guide disc bearing housing 26. Thus, it is possible to adjust the first wedge-shaped part 38 relative to the guide disc bearing housing 26 by means of the worm 42. The drive elements 45 to 50 at the opposite side are constructed and arranged in the same manner, but with the difference that the hinge piece, designated 45, is rigidly connected to the part *2a* of the stand upright. A second wedge-shaped part 51 is located in the interior of the part *2a* of the stand upright and is longitudinally displaceably connected to the first wedge-shaped part 38 only by way of a hydraulic working cylinder 52. A clamping member 54, rigidly connected to the guide disc bearing housing 26, is located between the wedge surfaces 53.

If it is desired to adjust the guide disc 5 in a radial direction, the stress between the wedge-shaped parts 38 and 51 is relieved by means of the working cylinder 52 by moving the wedge-shaped part 51 downwardly as shown in FIG. 6. The entire guide disc bearing housing 26 and thus also the guide disc 5 can subsequently be displaced radially by turning the worm 48. Accordingly, the parts 39 to 44, together with the wedge-shaped parts 38 and 51 and the clamping member 54, also perform this radial movement relative to the guide disc 5, without these parts moving relative to one another. A sliding movement is thereby effected between the first wedge-shaped part 38 and the left hand inner surface (as viewed in FIG. 6) of the part *2a* of the stand upright and, of course, also between the second wedge-shaped member 51 and the right hand inner guide surface of the part *2a* of the stand upright. When the correct position has been reached, pressure medium pressure is admitted to the working cylinder 52 and the second wedge-shaped part 51 is displaced upwardly, so that the clamping member 54, and thus also the guide disc bearing housing 26 together with the guide disc 5, are reliably clamped on the part 2a of the stand upright in a play-free manner.

The second wedge-shaped part 51 of FIG. 6 also has to be drawn downwardly by means of the working cylinder 52 for axial adjustment of the guide disc 5, in order to relieve the wedging stress. If the worm shaft 42 is then activated, a relative movement takes place between the guide disc bearing housing 26 or the clamping member 54 thereof on the one hand and, on the other hand, the first wedge-shaped part 38. However, since the guide disc bearing housing 26 together with guide disc 5 are retained in a radial direction relative to the guide disc 5 by the adjusting spindle 50, only the wedge-shaped parts 38 and 51 can be displaced. The wedge-shaped parts 38 and 51 then urge the clamping member 54 either to the right or left (as viewed in FIG. 5) according to the direction of rotation of the worm 42, the two wedge-shaped parts 38 and 51 being moved either downwardly or upwardly relative to the first part 2a of the stand upright. When the guide disc 5 has then reached its desired axial position, the guide disc can be reliably locked in position by admitting pressure medium to the working cylinder 52, the clamping member 54 being retained in the desired position in a play-free manner by the two wedge-shaped parts 38 and 51.

Figure 7:
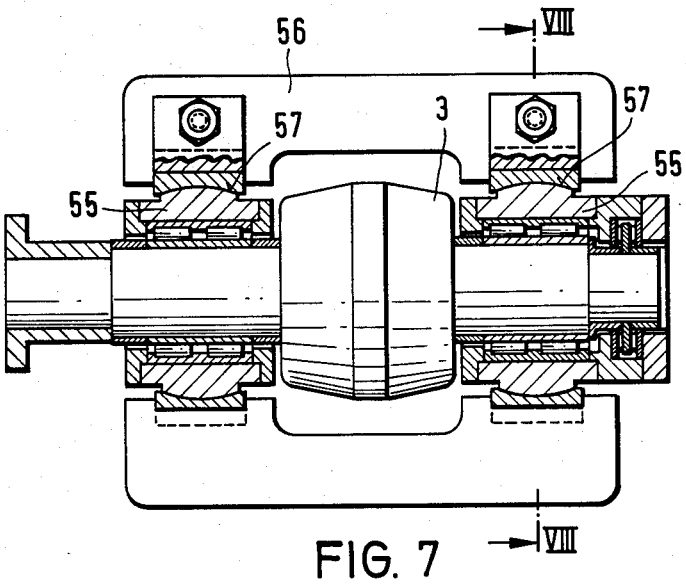
FIG. 7 is a section taken along the line VII—VII of FIG. 2, showing one of the skew rolls.
Figure 8:
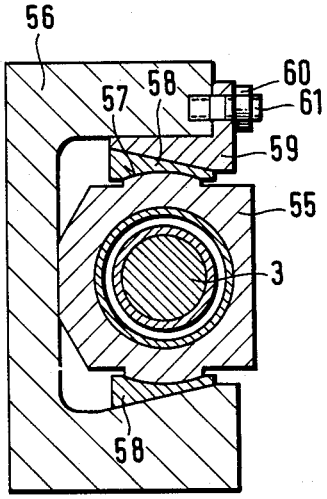
FIG. 8 is a section taken along the line VIII—VIII of FIG. 7.

In order to be able to mount the skew rolls 3 in only one part 2a or 2b of the stand upright, and also to be able to remove them towards the parting line 8, the skew rolls 3 are journalled in bearing housings 55 at each end of the skew rolls 3, the bearing housings 55 in turn being mounted in chocks 56, as shown in FIGS. 7 and 8. The bearing housings 58 have spherical segmental outer surfaces 57, and can be held by counter-members 58 of complementary construction. In order to clamp the bearing housings 55 in the chocks 56 of the parts 2a and 2b of the stand upright in a play-free manner, only one clamping wedge 59 serves for each bearing housing 55 and is prestressed by a nut 60 on a stud bolt 61, such that the clamping wedge rigidly clamps the counter-members 58 and the bearing housing 55 within the chock 56 in a play-free manner.

We claim:

1. A skew rolling mill for tubes, having a stand upright in two parts which are laterally separable along a substantially vertical parting line, one part being fixed and the other movable horizontally transverse to a pass line through said mill a pair of driven skew rolls which are journalled adjacent to one another so as to be inclined relative to the pass line, and a pair of driven guide discs which are journalled in the stand upright so as to be disposed in a vertical plane and respectively above and below the pass line, one skew roll being journalled in one part of the stand upright and the other skew roll being journalled in the other part of the stand upright, the skew rolls and guide discs being removable towards the substantially vertical parting line, and clamping means being provided to enable the two parts of the stand upright to be clamped together in a play-free manner.

2. A skew rolling mill as claimed in claim 1, in which the clamping means enabling the two parts of the stand upright to be clamped to one another comprise tie rods which are subjected to pre-stress by means of hydraulically operable nuts.

3. A skew rolling mill as claimed in claim 2 in which the guide discs are overhung mounted and are clamped in a play-free and rotationally fixed manner on their respective drive shafts by a tie rod of greater length which is pre-stressed by a hydraulic arrangement.

4. A skew rolling mill as claimed in claim 2, in which the tie rods are disposed in one part of the stand upright and have T-heads which engage corresponding recesses in the other part of the stand upright, the T-heads being turned in such recesses into their clamping positions and then subjected to the pre-stress.

5. A skew rolling mill as claimed in claim 4, in which the guide discs are overhung mounted and are clamped in a play-free and rotationally fixed manner on their respective drive shafts by a tie rod of greater length which is pre-stressed by a hydraulic arrangement.

6. A skew rolling mill as claimed in claim 1, in which the guide discs are overhung mounted and are clamped in a play-free and rotationally fixed manner on their respective drive shafts by a tie rod of greater length which is pre-stressed by a hydraulic arrangement.

7. A skew rolling mill as claimed in any of claims 1, 2, 4, 6, 3 or 5 in which the guide discs are adjustable in position.

8. A skew rolling mill as claimed in claim 7, in which the guide discs are journalled on an axially and radially play-free manner in respective axially and radially adjustable bearing housings, and in which two wedge-shaped parts are provided for each of the radially and axially adjustable bearing housings for the purpose play-free clamping thereof in the respective part of the stand upright, the mutually facing, sloping surface of which wedge-shaped parts hold therebetween a clamping portion of the respective guide disc bearing housing, and the parallel outer surfaces of which wedge-shaped parts are disposed between parallel guide surfaces of the respective part of the stand upright, a first one of the wedge-shaped parts being secured to the guide disc bearing housing so as to be adjustable relative thereto, and a second one of the wedge-shaped parts being coupled to the first wedge-shaped part by means of a clamping cylinder.

9. A skew rolling mill as claimed in claim 8 in which the skew rolls are adjustable in position.

10. A skew rolling mill as claimed in claim 8 in which the skew rolls are guided and held by respective chocks in the two parts of the stand upright and are journalled in separate bearing housings provided at each end of each roll and disposed in the chocks, the bearing housings being held in a play-free manner by clamping wedges which are each clamped held by only one bolt or nut per bearing.

11. A skew rolling mill as claimed in claim 7 in which both of said guide discs are journalled in said one part of the stand upright.

12. A skew rolling mill as claimed in claim 11 in which the skew rolls are adjustable in position.

13. A skew rolling mill as claimed in claim 11 in which the skew rolls are guided and held by respective chocks in the two parts of the stand upright and are journalled in separate bearing housings provided at each end of each roll and disposed in the chocks, the bearing housings being held in a play-free manner by clamping wedges which are each clamped held by only one bolt or nut per bearing.

14. A skew rolling mill as claimed in claim 7 in which both of said guide discs are journalled in said one part of the stand upright.

15. A skew rolling mill as claimed in claim 14 in which the skew rolls are adjustable in position.

16. A skew rolling mill as claimed in claim 14 in which the skew rolls are guided and held by respective chocks in the two parts of the stand upright and are journalled in separate bearing housings provided at each end of each roll and disposed in the chocks, the bearing housings being held in a play-free manner by clamping wedges which are each clamped held by only one bolt or nut per bearing.

17. A skew rolling mill as claimed in claim 1, 2, 4, 6, 3 or 5 in which both of said guide discs are journalled in said one part of the stand upright.

18. A skew rolling mill as claimed in claim 17 in which the skew rolls are adjustable in position.

19. A skew rolling mill as claimed in claim 17 in which the skew rolls are guided and held by respective chocks in the two parts of the stand upright and are journalled in separate bearing housings provided at each end of each roll and disposed in the chocks, the bearing housings being held in a play-free manner by clamping wedges which are each clamped held by only one bolt or nut per bearing.

20. A skew rolling mill as claimed in claim 7 in which the skew rolls are adjustable in position.

21. A skew rolling mill as claimed in claim 7 in which the skew rolls are guided and held by respective chocks in the two parts of the stand upright and are journalled in separate bearing housings provided at each end of each roll and disposed in the chocks, the bearing housing being held in a play-free manner by clamping wedges which are each clamped held by only one bolt or nut per bearing.

22. A skew rolling mill as claimed in any of claims 1, 2, 4, 6, 3 or 5, in which the skew rolls are adjustable in position.

23. A skew rolling mill as claimed in any of claims 1, 2, 4, 6, 3 or 5 in which the one part of the stand upright, to which the two guide discs are journalled, is fixed, the other part of the stand upright being laterally displaceable.

24. A skew rolling mill as claimed in any of claims 1, 2, 4 or 6 in which the skew rolls are guided and held by respective chocks in the two parts of the stand upright and are journalled in separate bearing housings provided at each end of each roll and disposed in the chocks, the bearing housings being held in a play-free manner by clamping wedges which are each clamped held by only one bolt or nut per bearing.

* * * * *

UNITED STATES PATENT AND TRADEMARK OFFICE

CERTIFICATE OF CORRECTION

PATENT NO. : 4,488,419

DATED : December 18, 1984

INVENTOR(S) : ALBERT QUAMBUSCH; WILFRIED SCHONEBERG

It is certified that error appears in the above-identified patent and that said Letters Patent is hereby corrected as shown below:

Column 1, line 24, change "kinds" to --types--.

Column 2, line 42, change "prevent" to --present--.

Column 6, line 4, change "3" to -- 32--.

Column 6, line 9, change "prestress" to --pre-stress--.

Column 6, line 17, change "for" to --of--.

Column 6, line 31, change "worn" to --worm--.

Column 7, line 28, change "52" to --42--.

Column 7, line 43, change "prestressed" to --pre-stressed--.

Signed and Sealed this

*Twentieth* Day of *August 1985*

[SEAL]

*Attest:*

DONALD J. QUIGG

*Attesting Officer* *Acting Commissioner of Patents and Trademarks*